US006568792B2

(12) United States Patent
Andrews et al.

(10) Patent No.: US 6,568,792 B2
(45) Date of Patent: May 27, 2003

(54) SEGMENTED HEATER CONFIGURATIONS FOR AN INK JET PRINTHEAD

(75) Inventors: John Richard Andrews, Fairport, NY (US); Gary Alan Kneezel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/733,069

(22) Filed: Dec. 11, 2000

(65) Prior Publication Data

US 2002/0075354 A1 Jun. 20, 2002

(51) Int. Cl.[7] ..... B41J 2/05
(52) U.S. Cl. ..... 347/48; 347/62
(58) Field of Search ..... 347/48, 50, 62, 347/15, 58, 56, 61

(56) References Cited

U.S. PATENT DOCUMENTS 4,339,762 A * 7/1982 Shirato et al. ..... 347/62
4,623,901 A * 11/1986 Nagashima ..... 347/206
4,870,433 A * 9/1989 Campbell et al. ..... 347/62
4,947,193 A * 8/1990 Deshpande ..... 347/62
5,481,287 A * 1/1996 Tachihara ..... 347/62
5,600,356 A * 2/1997 Sekiya et al. ..... 347/62
6,270,201 B1 * 8/2001 Kasperchik et al. ..... 347/65
6,290,333 B1 * 9/2001 Wade et al. ..... 347/50

* cited by examiner

*Primary Examiner*—Judy Nguyen
*Assistant Examiner*—Julian D. Huffman
(74) *Attorney, Agent, or Firm*—Oliff & Berridge, PLC

(57) ABSTRACT

Segmented heater configurations for ejecting fluid on to a medium having heater segments, where area and power level dissipation of each heater segment in the heater configuration are chosen such that different sized drops of fluid are ejected depending on the pulse voltage and/or pulse width used. As the pulse voltage and/or pulse width applied to a particular channel is increased, more heating segments in that ejection channel nucleate bubbles and produce larger drops. As a result, drop volume and spot size of the ejected fluid can be increased as pulse voltage and/or pulse width increase. For side-shooting devices, the heaters and power densities are configured such that the segment closest to the orifice nucleates its bubble first. For devices which eject droplets perpendicular to the plane of the heater, the heater segments can be arranged into a two-dimensional array. Each segment has a different power density. The segmented arrays are arranged with the highest power density elements located near the center of the array. Other heater segments having lower power densities are located progressively further from the center heater segments. As the heater segment power voltage and/or pulse width is increased, successively more heater elements nucleate bubbles and produce larger drops of ejected fluid.

19 Claims, 8 Drawing Sheets

SEGMENTED HEATER CONFIGURATIONS FOR AN INK JET PRINTHEAD

BACKGROUND OF THE INVENTION

1. Field of Invention

This invention relates to thermal fluid ejection systems.

2. Description of Related Art

Thermal fluid ejection systems, such as, for example, thermal ink jet printers, use thermal energy selectively produced by resistors located in fluid filled channels or chambers near channel-terminating nozzles. Firing signals are applied to the resistors through associated drive circuitry to momentarily vaporize the fluid and form bubbles on demand. Each temporary bubble expels a fluid droplet and propels it towards a receiving medium. The fluid ejector head is usually sealingly attached to one or more fluid supply containers and the combined fluid ejector and container form a cartridge assembly which is, in various exemplary embodiments, reciprocated to eject one swath of fluid at a time on a stationarily-held receiving medium such as paper.

A typical thermal fluid ejector head consists of an array of resistive heaters, each of which is located within a channel that is filled with fluid during operation. When a given heater is pulsed, that heater nucleates a fluid vapor bubble, which grows and propels a droplet of fluid out of the channel and onto the receiving medium. The size of the ejected fluid droplet is particularly dependent upon the maximum size of the bubble, which is in turn partially dependent upon the amount of thermal energy transferred to the fluid and upon the heater size.

For example, in a standard thermal ink jet printhead, the heaters are nominally uniform. In such a fluid ejector head, substantially the entire heater surface reaches the bubble nucleating temperature at the same time when the appropriate magnitude voltage pulse is applied. Once the bubble nucleates and grows, little thermal energy is usually transferred into the fluid because of the poor thermal conductivity of the fluid vapor bubble. Thus, for standard heater construction, in which bubble growth occurs substantially over the entire heater surface at the same time, continued power dissipation in the heater is not effective in forming larger fluid drops.

During ejection operations, the droplet ejected from the fluid ejector head to the receiving member forms a spot of fluid. In a thermal ink jet printer, the ejected fluid is ink that forms a spot as a part of a desired image. The human eye is very sensitive to changes in spot size, especially when shaded areas and graphics are being produced, especially for color printing. Therefore, uniformity of spot size of a large number of droplets is crucial to maintaining image quality in thermal ink jet printing. If the volume of ejected droplets varies greatly within a single image, the lack of uniformity in droplet volume will noticeably affect the size of the ink spots forming the image and detract from the quality of the image. Similarly, if volumes of droplets ejected from the printhead differ during subsequent printings of the same image, then printing consistency cannot be maintained. Alternatively, by controllably varying the droplet size, continuous tone and cluster dot half-tone printing can be obtained.

SUMMARY OF THE INVENTION

Accordingly, because print quality in thermal ink jet printing highly depends on the controllability of the printhead, i.e., through the use of heating elements in specific configurations to vary controllably the size of drops that are recorded on the medium, a device which can better control a range of sizes of drops of ink which are ejected is desired. Similarly, in general, the ability to control the drop size over a range of sizes is desirable in any fluid ejection system, not only thermal ink jet printers.

A heater element of substantially constant resistance and cross-section across its length and width tends to have a limited range of bubble sizes, and hence drop sizes, regardless of applied pulse width and/or voltage. However, a design in which heater elements are controllably nonuniform can nucleate at a relatively low level of energy a smaller bubble size over a segment of the heater element where the power density is highest. Successively larger bubbles, and hence larger ejected droplets, can be generated when the pulse width and/or voltage is increased to the level that the power density is raised sufficiently in other segments of the heater element.

This invention will describe various configurations of segmented heaters, i.e., for example, both where the different heater segments having different resistances are electrically connected in series with each other, and in which the heater segments are electrically connected in parallel with each other. In one aspect, configurations are described in which the bubble nucleation occurs sequentially along the length of the heater, with the first bubble being closest to the edge of the device, as would be appropriate in a side-shooting printhead. In another aspect, configurations are also described in which bubble nucleation occurs first in the center of the heater element array and proceeds substantially radially outward, as would be appropriate for a roof-shooting printhead.

Conceptually, the simplest configuration of the segmented heaters is the one in which the heater segments of different resistance are connected end to end in series. For the case where the different resistances are achieved by different doping levels in the heater element, one problem associated with serially-connected heater segments is that dopants diffuse directly from one heater segment type into another heater segment type, causing the heater segments, sometimes each with various doping levels, to degrade.

Yet another problem associated with serially-connected heater segments is that the heater segments are heavily doped in order to have sufficiently low resistance that they can be pulsed to eject droplets at voltages of less than 50 volts. Accordingly, for the case with polysilicon heater elements, heavily doped heater segments can be rough in texture, which results in unwanted bubble nucleation sites.

One problem associated with a parallely-connected heater segments is that there may be very limited space for the electrical connection of the leads to the heater segments. In addition, some high resolution fluid ejectors have small channel spacings that cause some parallel connections to be impractical.

Accordingly, this invention provides apparatus and systems that have improved parallely-connected heater segments electrically connected so that there are lower print voltage requirements, thus reducing the cost of the power supplies.

This invention separately provides apparatus and systems that allow the spacing between heater segments to be varied to modify and/or control fluid ejection characteristics.

This invention separately provides apparatus and systems that provide improved controllability in each heater segment.

This invention separately provides apparatus and systems that have heater segments with various lengths and/or widths, and by different doping levels, in order to produce the different power densities in each heater segment.

This invention separately provides apparatus and systems that have parallely-connected heater segments with reduced heater segment degradation.

This invention separately provides apparatus and systems that reduces pathways for dopants to diffuse from one heater segment type into another during high temperature processing.

This invention separately provides apparatus and systems that provide heater segments having lower doping levels and/or lower resistance.

This invention separately provides apparatus and systems that relax space limiting factors in fluid ejector devices.

This invention separately provides apparatus and systems that allow high voltage and low voltage lines to be spaced further apart.

This invention separately provides apparatus and systems that provide heater segments having power density variations having increased radial symmetry.

This invention separately provides apparatus and systems having heater segments that are able to fire small droplets of fluid.

In various exemplary embodiments of the apparatus and systems according to this invention, area and power level dissipation of each heater segment in the ink jet printhead are chosen such that different sized drops of fluid are ejected depending on the pulse voltage and/or pulse width used. As the pulse voltage and/or pulse width applied to a particular channel is increased, more heating segments in that ejection channel nucleate bubbles and produce larger drops. As a result, drop volume and spot size of the ejected fluid can be increased as pulse voltage and/or pulse width increase.

In various other exemplary embodiments, the heater segments are arranged into a two-dimensional array. Each segment has a different power density. The segmented arrays are arranged with the highest power density elements located near the center of the array. Other heater segments having lower power densities are located progressively further from the center heater segments. As the heater segment power voltage and/or pulse width is increased, successively more heater elements nucleate bubbles and produce larger drops of ejected fluid.

In particular, in various exemplary embodiments, the nucleating bubbles spread from the center outward in a radial fashion. In various exemplary embodiments, the heater segments have a wide variety of geometrical shapes which enable a more radial variation in the power density.

These and other features and advantages of this invention are described in, or are apparent from, the following detailed description and various exemplary embodiments of the apparatus and systems according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
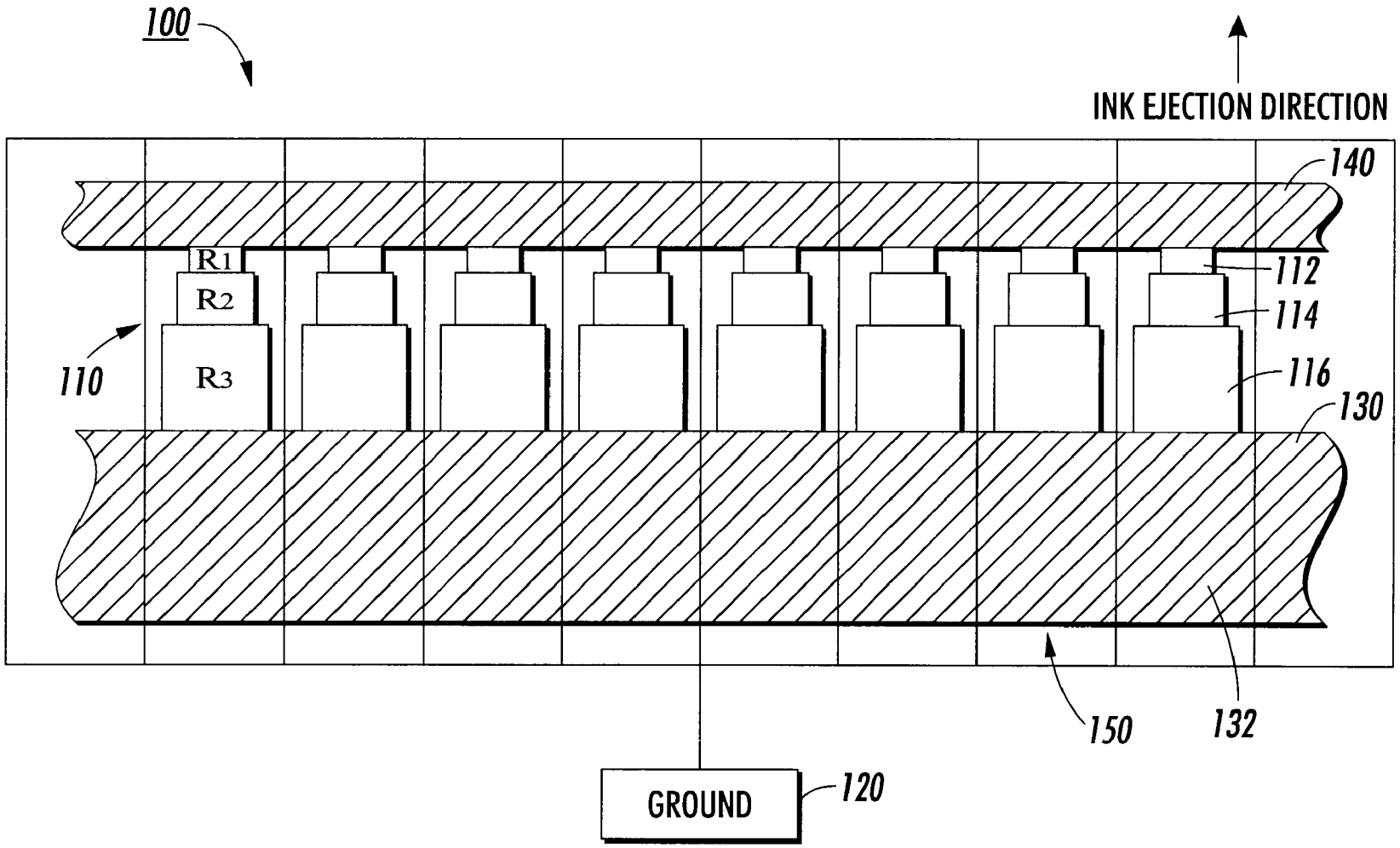
FIG. 1 is a block diagram of an exemplary embodiment of a conventional segmented heater structure having heater segments serially connected such that the resulting increase in power density proceeds unidirectionally as the pulse width and/or voltage increases.

FIG. 1 is a block diagram of one exemplary embodiment of a segmented heater 100 having a plurality of heater devices 150, a common ground 120 and a common power supply 140. Each heater device 150 is connected to the common ground 120 and to the power supply 140 and includes a driver transistor 132. The driver transistors 132 are shown as portions of an individual driver transistor block 130 in FIG. 1. Each heater device 150 also includes a segmented heater structure 110 having a plurality of heater elements 112–116 that are connected in series. In each heater device 150, the heater segments 112–116 are designed to vary in power density so that the different heater segments 112–116 reach a bubble nucleation temperature at different applied power supply levels. For the smallest bubble-nucleating power pulse, only the first segment 112 having the highest power density fires a drop. If the pulse power is suitably increased by increasing the pulse voltage or pulse width, the second and third segments 114 and 116 successively join in creating the vapor bubble in the fluid.

It should be appreciated that, in this and other exemplary embodiments of the segmented heater according to this invention, the heater segments 112–116 can be fabricated of polysilicon, or any other known material without departing from the spirit and scope of the invention.

The heater segments 112–116 are fabricated such that, for any given power pulse applied to the heater devices 110, each heater segment 112–116 experiences a different power density. As a result, for a given applied voltage pulse, each heater segment 112–116 reaches a different temperature, as demonstrated in the following example.

In each heater device 110, the total resistance in the heater segments 112–116 is $R_1+R_2+R_3$. For a voltage drop V across the heater segments 112–116, the current through each segment 112–116 is $I=V/(R_1+R_2+R_3)$. In this example, the power in the $i^{th}$ segment is:

$$P=I^2R_i=I^2\rho_iL_i/w_i \quad (1)$$

where:

$\rho_i$ is the sheet resistance of each segment;

$L_i$ is the length of each segments; and $w_i$ is the width of each segment$_i$ The power density, i.e., the power per unit area $P_D$, in each heater segment 112–116 is:

$$P_D=P/L_iw_i=I^2\rho_i/w_i^2 \quad (2)$$

The temperature of each heater segment 112–116 rises according to its power density in that heater segment 112–116. If all of the heater segments 112–116 have the same sheet resistance, then the first heater segment 112 will fire first because the first heater segment 112 has the smallest width.

In the serially-connected segmented heater device 110, as shown in FIG. 1, the power density $P_D$ is inversely proportional to the square of the segment width $_i$. Thus, if the sheet resistance is the same for all of the heater segments 112–116, the narrowest segment, i.e., the first segment 112, will reach the bubble nucleating temperature first as the pulse voltage and/or the pulse width increases. That is, while current flows through all of the heater segments 112–116, only the first heater segment 112 has a power density $P_D$ that is sufficient, given the resistance $R_1$ of the first heater segment 112, to raise the temperature of the fluid adjacent to the heater segments 112–116 above the bubble-nucleation temperature of the fluid. As outlined above, the size of the bubble, and thus the size of the resulting fluid droplet, is a function of the area of the heater device that has a temperature greater than the bubble-nucleation temperature. Thus, the size of the bubble, and thus the size of the resulting fluid droplet, is based only on the area of the first heater segment 112.

As the pulse voltage and/or the pulse width increases further, the temperature of the first heater segment 112 remains above the bubble-nucleating temperature. Furthermore, even though the temperature of the heater segment 112 increases, this further increase in the temperature of the first heater segment 112 has at most only a minimal effect on the size of the bubble, and thus the size of the resulting fluid droplet, due to the high thermal resistance of the bubble. At the same time, the temperatures of both the second and third heater segments 114 and 116 rise toward the bubble-nucleating temperature. However, because the width of the second heater segment 114 is narrower than the width of the third heater segment 116, the temperature of the second heater segment 114 increases more rapidly than the temperature of the third heater segment 116. Thus, at some particular pulse voltage and/or pulse width, the temperature of the second heater segment 114 reaches the bubble-nucleating temperature. As a result, the size of the resulting bubble becomes dependent on the areas of both the first and second heater segments 112 and 114. Thus, the size of the resulting fluid droplet increases.

Similarly, as described above, as the pulse voltage and/or pulse width continues to increase, the temperature of each of the first-third heater segments 112–116 continues to increase, with the temperature of the third heater segment 116 rising towards the bubble-nucleating temperature. Eventually, at some pulse voltage and/or pulse width, the temperature of the third heater segment 116 also reaches the bubble-nucleating temperature. As a result, the size of the resulting bubble, and thus the size of the resulting fluid droplet, depends on the areas of all three of the first-third heater segments 112–116.

As indicated above, the drop size or volume and, thus, the resulting spot size of the ejected fluid on the recording medium increases proportionally with the area of the segmented heater that has a temperature above the bubble-nucleating temperature. Accordingly, segmented heater 100 is particularly advantageous for the gray scale printing, because the heater segment 112 that will fire the smallest droplet may be fired independently of the second and third heater segments 114 and 116 since the first heater segment 112 will reach the bubble-nucleating temperature first.

As a result, drop volume and spot size may be increased as the pulse voltage and/or the pulse width increase. Furthermore, the side-shooting printhead configuration shown in FIG. 1, where the first heater segment 112 is the closest to the nozzle of the ink ejecting channel is advantageous, because the ink column in front of the first heater segment 112 is the smallest and the ink column on the other side of the heater segment 112 is the largest. As a result, a smaller bubble from first heater segment 112 can push a fluid droplet out of the channel with high velocity. During fluid ejection printing operations, fast drop velocity is desirable because drops that are ejected with a high velocity are less susceptible to forces which tend to misdirect the drops.

Figure 2:
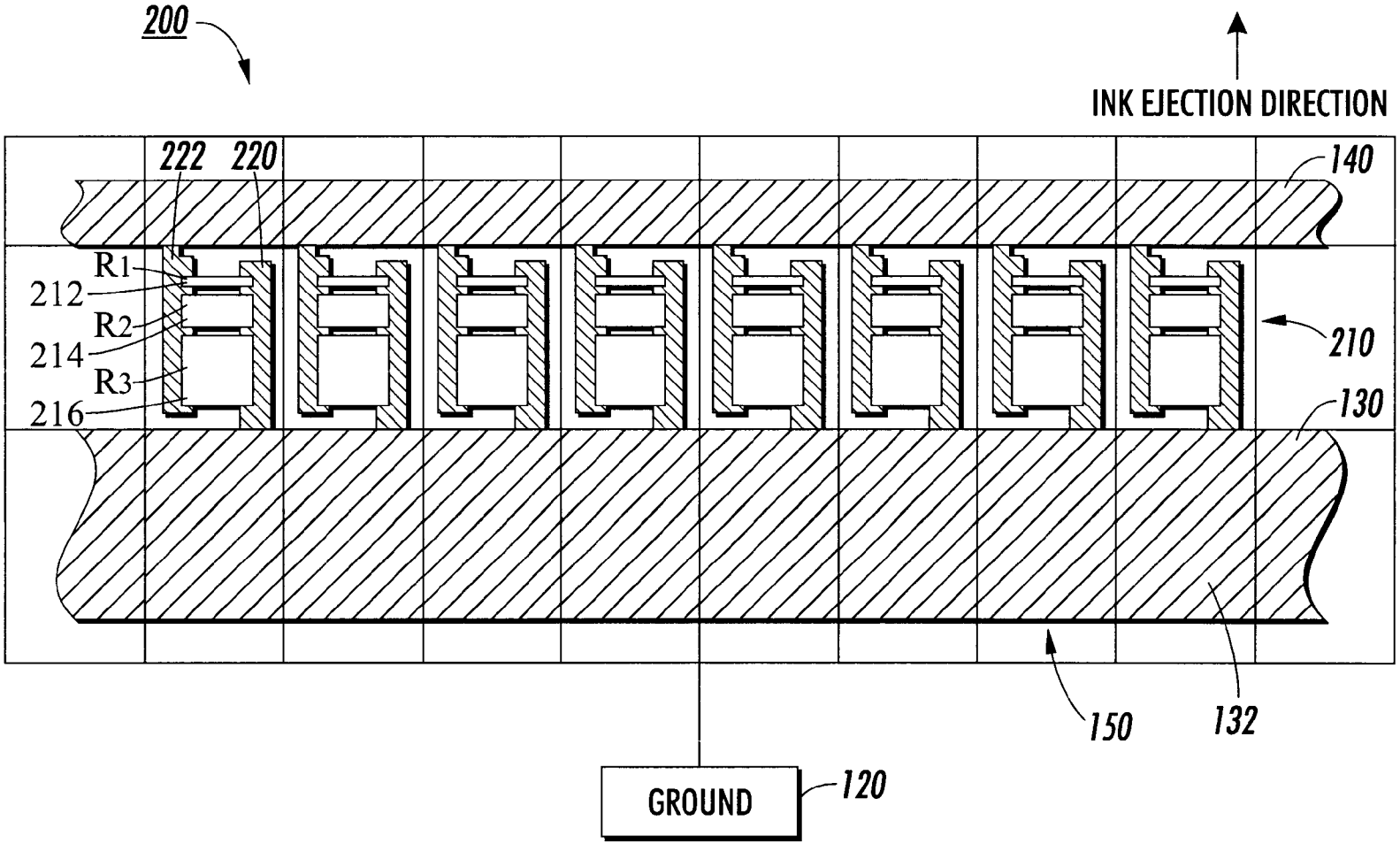
FIG. 2 is a block diagram of a first exemplary embodiment of a segmented heater structure having parallely-connected heater segments according to this invention such that the resulting increase in power density proceeds unidirectionally as the pulse width and/or voltage increases.

FIG. 2 shows a first exemplary embodiment of a segmented heater 200 having parallely-connected segments which are configured such that power density increases unidirectionally as the applied electrical energy increases. As shown in FIG. 2, a segmented heater 200 has a plurality of heater devices 150, a common ground 120 and a common power supply 140. Each heater device 150 is connected to the common ground 120 and power supply 140 and includes a driver transistor 132. The driver transistors 132 are shown as portions of an individual driver transistor block 130. Each heater device 150 also includes a segmented heater structure 210 having a plurality of heater elements 212–216 that are connected in parallel between the corresponding drive transistor 132 and the power supply 140. In each heater device 150, the heater segments 212–216 are designed to vary in power density so that the different heater segments 212–216 reach a bubble nucleation temperature at different applied power supply levels.

In this exemplary embodiment, a plurality of leads 222 extend from the power source 140, and a plurality of leads 220 extend from the corresponding driver transistor 132. The heating segments 212–216 are spaced apart and electrically connected between the leads 222 and 220, so that electrical current travels in parallel through each heater segment 212–216. The heater segments 212–216 are fabricated such that, for any given power pulse applied to the heater structure 210, each heater segment 212–216 experiences a different power density. As a result, for a given applied voltage pulse, each heater segment 212–216 reaches a different temperature.

Each heater segment 212–216 extends into the leads 220 and 222 far enough that a connection can be made between that heater segment 212–216 and the material of the leads 220 and 222. In this example, the power dissipated in the $i^{th}$ segment is:

$$P=V^2/R_i=V^2w_i/\rho_iL_i \quad (3)$$

where:

V=The voltage across the segments;

$\rho_i$ is the sheet resistance of each segments;

$L_i$ is the length of each segments; and $w_i$ is the width of each segments

The power density $P_D$ in each segment is:

$$P_D=P/L_iw_i=V^2/\rho_iL_i^2 \quad (4)$$

In the segmented heater 200, the power density $P_D$ is inversely proportional to the square of the length of each heater segment 212–216, as well as inversely proportional to the sheet resistivity of each heater segment 212–216. Heater segments 212–216 are shown as all having the same length L. In order to make the first heater segment 212 reach the bubble-nucleating temperature first, the sheet resistivity of the first heater segment 212 is made smallest by doping so that the first heater segment 212 has the highest power density. Accordingly, the first heater segment 212 fires a drop of fluid first, i.e., at the smallest firing pulse width and/or voltage. As discussed previously, while some current flows through all of the heater segments 212–216 in each heater structure 210, the current preferentially flows through the first heater segment 212 due to its lower resistance. Thus, only the first heater segment 212 has a power density that is sufficient, given the resistance $R_1$ of the first heater segment 212, to raise the temperature of the fluid adjacent to the heater segments 212–216 above the bubble-nucleation temperature of the fluid. Therefore, the size of the bubble, and thus the size of the resulting fluid droplet, is a function of the area of the heater device 210 that has a temperature greater than the bubble-nucleation temperature. Thus, the size of the first bubble, and thus the size of the resulting first fluid droplet, is based only on the area of the first heater segment 212.

As the pulse voltage and/or the pulse width increases further, the temperature of the first heater segment 212 continues to remain above the bubble-nucleating temperature. Furthermore, even though the temperature of the heater segment 212 increases, this further increase in the temperature of the first heater segment 212 has at most only a minimal effect on the size of the bubble, and thus the size of the resulting fluid droplet, due to the high thermal resistance of the bubble. At the same time, the temperatures of both the second and third parallely-connected heater segments 214 and 216 rise toward the bubble-nucleating temperature.

However, because the sheet resistivity of the second heater segment 214 has been made lower than the sheet resistivity of the third heater segment 216, more current flows through the second heater segment 214 than the third heater segment 216. Thus, the temperature of the second heater segment 214 increases more rapidly than the temperature of the third heater segment 216. Accordingly, at some point, while the particular pulse voltage and/or pulse width is increasing, the temperature of the second heater segment 214 reaches the bubble-nucleating temperature. As a result, the size of the resulting bubble becomes dependent on the areas of both the first and second heater segments 212 and 214. Thus, the size of the resulting fluid droplet increases.

Similarly, as previously described, as the pulse voltage and/or pulse width continues to increase, the temperature of each of the first-third heater segments 212–216 continues to increase, with the temperature of the third heater segment 216 rising towards the bubble-nucleating temperature. Eventually, at some point during the increase in pulse voltage and/or pulse width, the temperature of the third heater segment 216 also reaches the bubble-nucleating temperature. As a result, the size of the resulting bubble, and thus the size of the resulting fluid droplet, depends on the areas of all three of the first-third heater segments 212–216. It should be appreciated that the sheet resistivity of the heater segments 212–216 can be controllably varied by doping the heater segments 212–216 with various doping materials known in the art.

Figure 3:
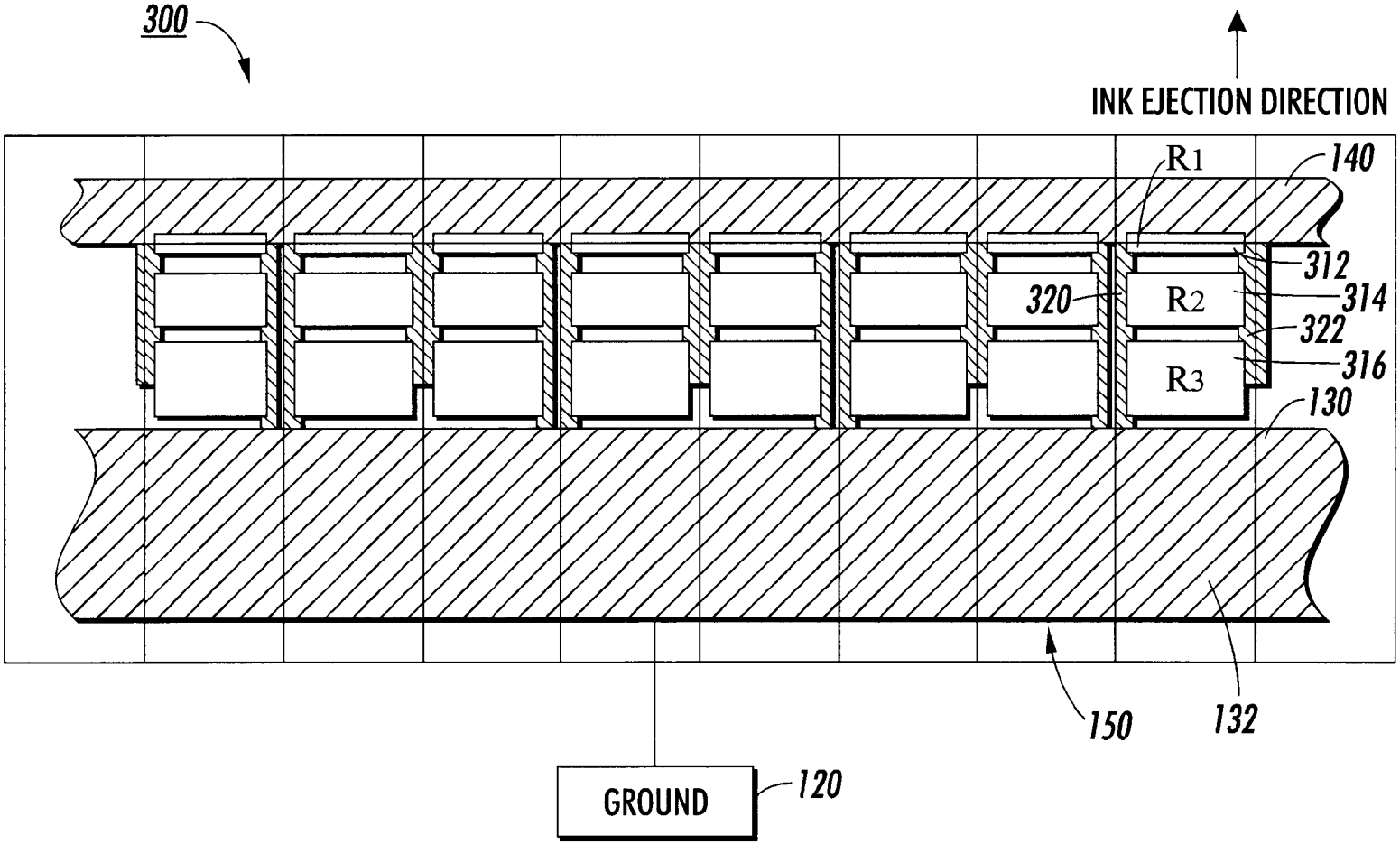
FIG. 3 is a block diagram of a second exemplary embodiment of a segmented heater structure having parallely-connected heater segments according to this invention such that the resulting increase in power density proceeds unidirectionally as the pulse width and/or voltage increases.

FIG. 3 is a block diagram of a second exemplary embodiment of a segmented heater 300 having parallely-connected heater segments which are configured such that power density increases unidirectionally as the applied electrical energy increases. As shown in FIG. 3, the segmented heater 300 has a plurality of heater devices 150, a common ground 120 and a common power supply 140. As with the previously-described exemplary embodiments, each heater device 150 is connected to the common ground 120 and to the power supply 140 and includes a driver transistor 132. The leads 322 that extend from the power supply 140 extend from the power supply 140 only between every other pair of adjacent heater segments 312–316. Thus, each lead 322 is connected to two sets of heater segments 312–316. Furthermore, the leads 320 that extend from driver transistors 130 are paired and alternately extend from the drive transistors 130. The heating segments 312–316 are spaced apart and electrically connected between the leads 322 and 320, so that electrical current travels in through each heater segment 312–316. The heater segments 312–316 in the segmented heater 300 are fabricated in the same manner as the segmented heater 200. Accordingly, as a result, each heater segment 312–316 reaches a different temperature for a selected pulse voltage and/or pulse width so that the drop of fluid in each heater segment 312–316 can be independently fired. By positioning the leads 322 and 320, and the heater segments 312–316 in this manner, space limiting factors in the segmented heater 300 are relaxed, and the high voltage line and the low voltage lines in the segmented heater 300 can be spaced further apart.

Figure 4:
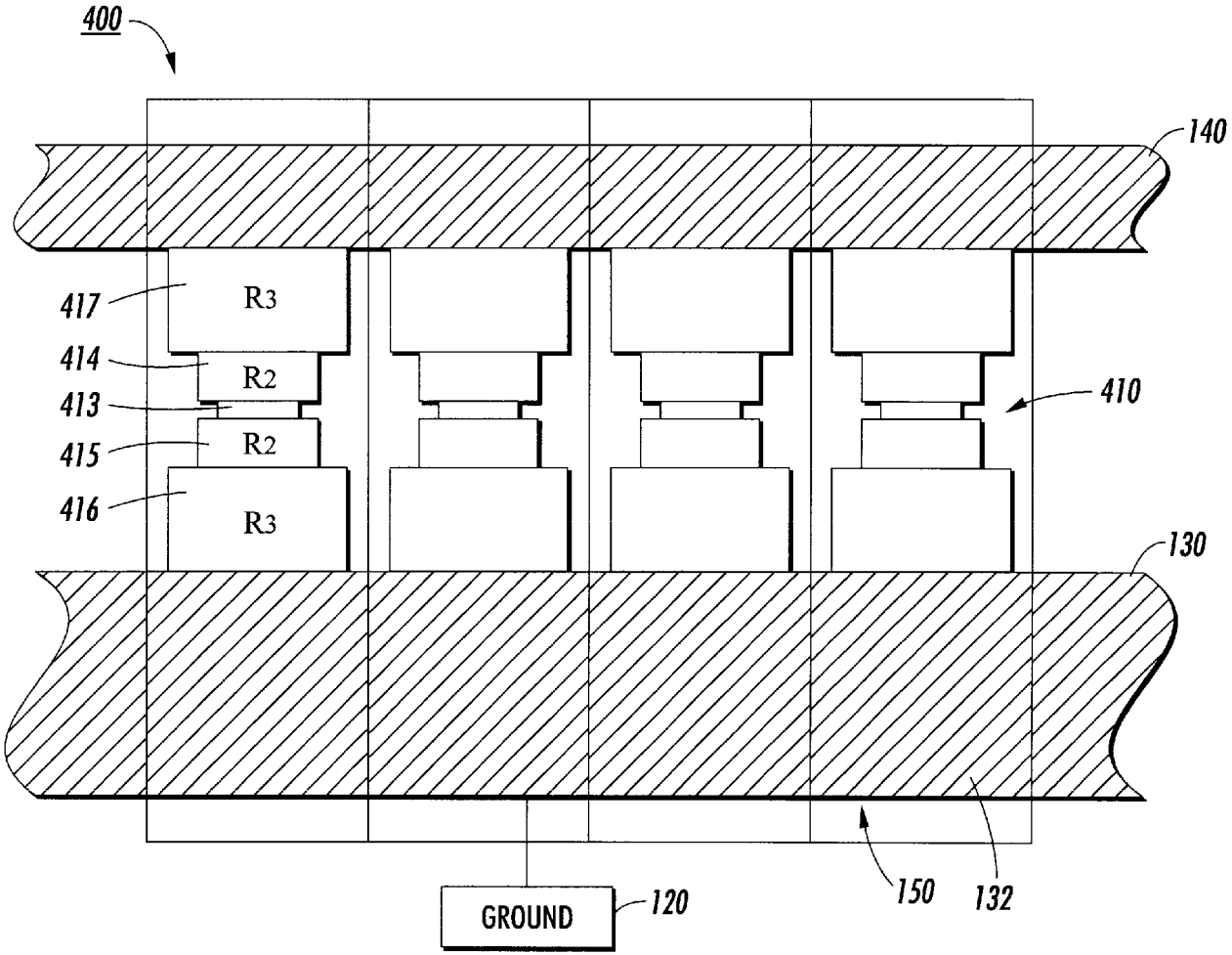
FIG. 4 a block diagram of a first exemplary embodiment of a segmented heater structure having serially-connected heater segments according to this invention such that the resulting increase in power density proceeds bidirectionally as the pulse width and/or voltage increases.

FIG. 4 is a block diagram of a first exemplary embodiment of a segmented heater 400 having serially-connected heater segments 413–417 which are configured such that the power density increases bidirectionally as the applied electrical energy increases according to this invention. As shown in FIG. 4, the segmented heater 400 has multiple heater segments 413–417 and has a plurality of heater devices 150, a common ground 120 and a common power supply 140. Each heater device 150 is connected to the common ground 120 and the power supply 140 and includes a driver transistor 130. Each heater device 150 includes a segmented heater structure 410 having a plurality of the heater segments 413–417 that are serially-connected.

In each heater device 150, the heater segments 413–417 are designed to vary in power density, so that the different heater segments 413–417 reach a bubble nucleation temperature at different applied power supply levels. In other words, while current flows through all of the heater segments 413–417, only the first heater segment 413 has a power density that is sufficient, given the resistance $R_1$ of the first heater segment 413, to raise the temperature of the fluid adjacent to the heater segments 413–417 above the bubble-nucleation temperature of the fluid. As outlined above, the size of the bubble, and thus the size of the resulting fluid droplet, is a function of the area of the heater device that has a temperature greater than the bubble-nucleation temperature. Thus, the size of the bubble, and thus the size of the resulting fluid droplet, at the smallest firing voltage and/or pulse width, is based only on the area of the first heater segment 413.

As the pulse voltage and/or the pulse width increases further, the temperature of the first heater segment 413 remains above the bubble-nucleating temperature. Furthermore, even though the temperature of the heater segment 413 increases, this further increase in the temperature of the first heater segment 413 has at most only a minimal effect on the size of the bubble, and thus the size of the resulting fluid droplet, due to the high thermal resistance of the bubble. At the same time, the temperatures of both the second heater segments 414 and 415, and third heater segments 416 and 417 rise toward the bubble-nucleating temperature. However, because the width of the second heater segments 414 and 415 are narrower than the width of the third heater segment 416 and 417, the temperature of the second heater segments 414 and 415 increase more rapidly than the temperature of the third heater segments 416 and 417. Thus, at some particular pulse voltage and/or pulse width, the temperature of the second heater segments 414 and 415 reach the bubble-nucleating temperature. As a result, the size of the resulting bubble becomes dependent on the areas of both the first and second heater segments 414 and 417. Thus, the size of the resulting fluid droplet increases.

Similarly, as described above, as the pulse voltage and/or pulse width continues to increase, the temperature of each of the first-third heater segments 413 and 417 continues to increase, with the temperature of the third heater segments 416 and 417 rising towards the bubble-nucleating temperature. Eventually, at some pulse voltage and/or pulse width, the temperature of the third heater segments 416 and 417 also reach the bubble-nucleating temperature. As a result, the size of the resulting bubble, and thus the size of the resulting fluid droplet, depends on the areas of all three of the first-third heater segments 413–417.

In other words, the segmented heater 400 is controlled so that the order of firing is bi-directionally symmetric. The firing order of the heater segments 413–417 is determined by the power density in each heater segment 413–417, which (from equation 2 for series-connected heater segments) is proportional to the sheet resistance $\rho_i$ and inversely proportional to the square of the heater segment width $w_i$. Thus, in the segmented heater 400, if all of the heater segments 413–417 have the same sheet resistance, and as the pulse voltage and/or the pulse width increases, the center heater segment 413 fires a drop first because the center heater segment 413 is the narrowest. Then, as the pulse voltage and/or the pulse width continues to increase, the intermediate heater segments 414 and 415, which are wider than the center heater segment 413, fire next. Finally, as the pulse voltage and/or the pulse width increases even further, the outside heater segments 416 and 417, which are the widest, fire last.

Figure 5:
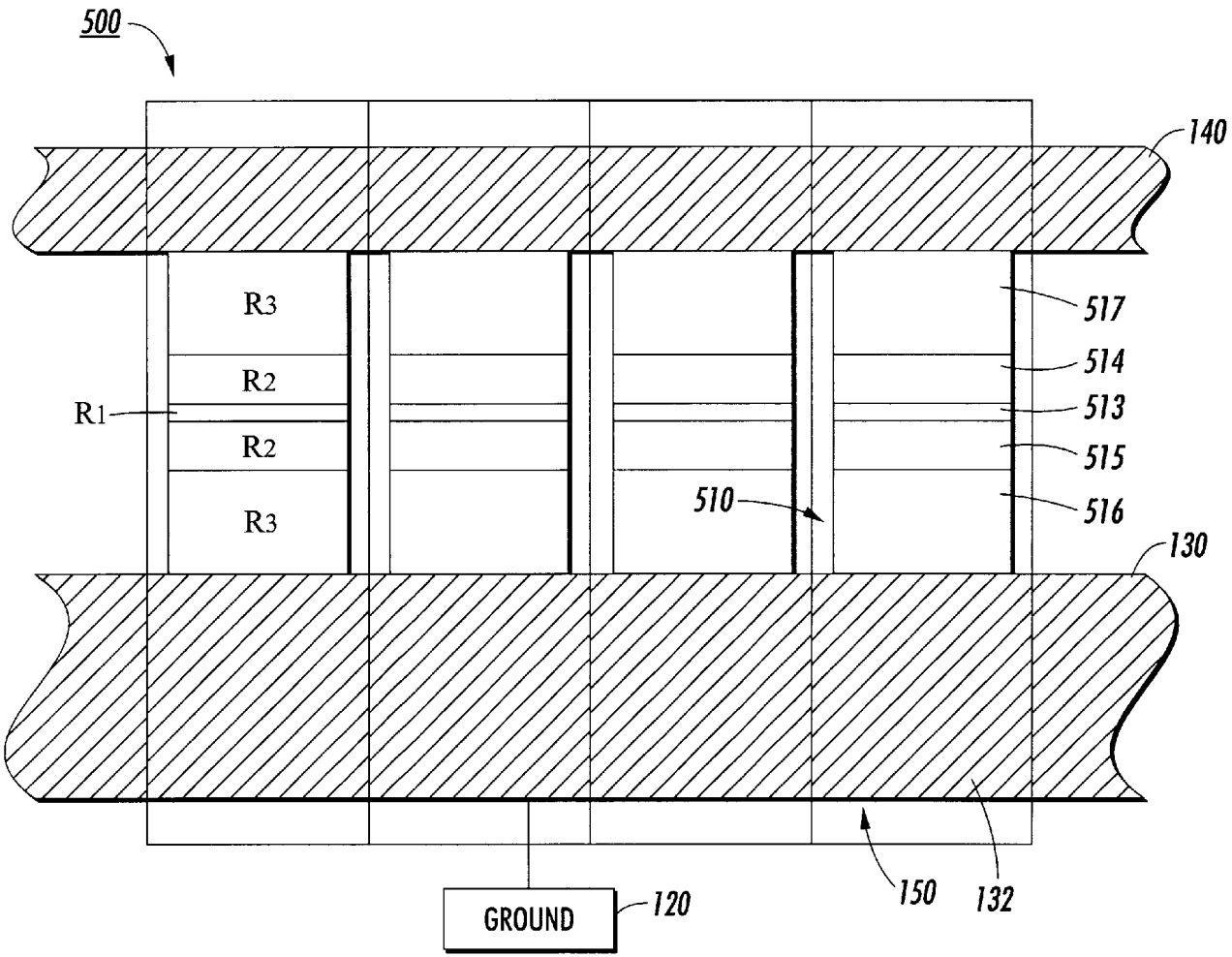
FIG. 5 a block diagram of a second exemplary embodiment of a segmented heater structure having serially-connected heater segments according to this invention such that the resulting increase in power density proceeds bidirectionally as the pulse width and/or voltage increases.

FIG. 5 is a block diagram of a second exemplary embodiment of a segmented heater 500 having serially-connected heater segments which are configured such that the power density increases bidirectionally as the applied electrical energy increases according to this invention. As shown in FIG. 5, the segmented heater 500 is configured in the same manner as segmented heater 400, with multiple heater segments 513–517, a plurality of heater devices 150, a common ground 120 and a common power supply 140. In the segmented heater 500, each of the heater segments 513–517 have the same width, but vary in length. Furthermore, in this second exemplary embodiment, the center heater segment 513, the intermediate heater segments 514–515, and outside heater segments 516–517 are each doped differently to controllably vary the sheet resistance of the heater segments 513–517. Accordingly, the center heater segment 513 is doped to have the highest power density, so that the center heater segment 513 will reach bubble nucleating temperature first as the power pulse voltage and/or pulse width increase.

In other words, as shown in Equation 2, in order to make the center heater segment 513 reach the bubble-nucleating temperature first, the sheet resistivity of the center heater segment 513 is made largest so that the center heater segment 513 has the highest power density. Accordingly, the center heater segment 513 fires a drop of fluid first, i.e., at the smallest firing pulse width and/or voltage. As previously discussed, while some current flows through all of the heater segments 513–517 in each heater structure 510, the current preferentially flows through the center heater segment 513 due to its lower resistance. Thus, only the center heater segment 513 has a power density that is sufficient, given the resistance $R_1$ of the center heater segment 513, to raise the temperature of the fluid adjacent to the heater segments 513–517 above the bubble-nucleation temperature of the fluid. Therefore, the size of the bubble, and thus the size of the resulting fluid droplet, is a function of the area of the heater device 510 that has a temperature greater than the bubble-nucleation temperature. Thus, the size of the first bubble, and thus the size of the resulting first fluid droplet, is based only on the area of the center heater segment 513.

As the pulse voltage and/or the pulse width increases further, the temperature of the center heater segment 513 continues to remain above the bubble-nucleating temperature. Furthermore, even though the temperature of the center heater segment 513 increases, this further increase in the temperature of the center heater segment 513 has at most only a minimal effect on the size of the bubble, and thus the size of the resulting fluid droplet, due to the high thermal resistance of the bubble. At the same time, the intermediate heater segments 514 and 515, and outside heater segments 516 and 517 rise toward the bubble-nucleating temperature.

Eventually, at some specific pulse voltage and/or pulse width, the temperature of the intermediate heater segments 514 and 515 reach the bubble-nucleating temperature. Finally, after the center heater segment 513 and the intermediate heater segments 514 and 515 reach bubble-nucleating temperature, the outside heater segments 516 and 517 reach the bubble-nucleating temperature. As a result, the size of the resulting fluid bubble, and thus the size of the resulting fluid droplet, depends on the sheet resistivity of all heater segments 513–517.

Figure 6:
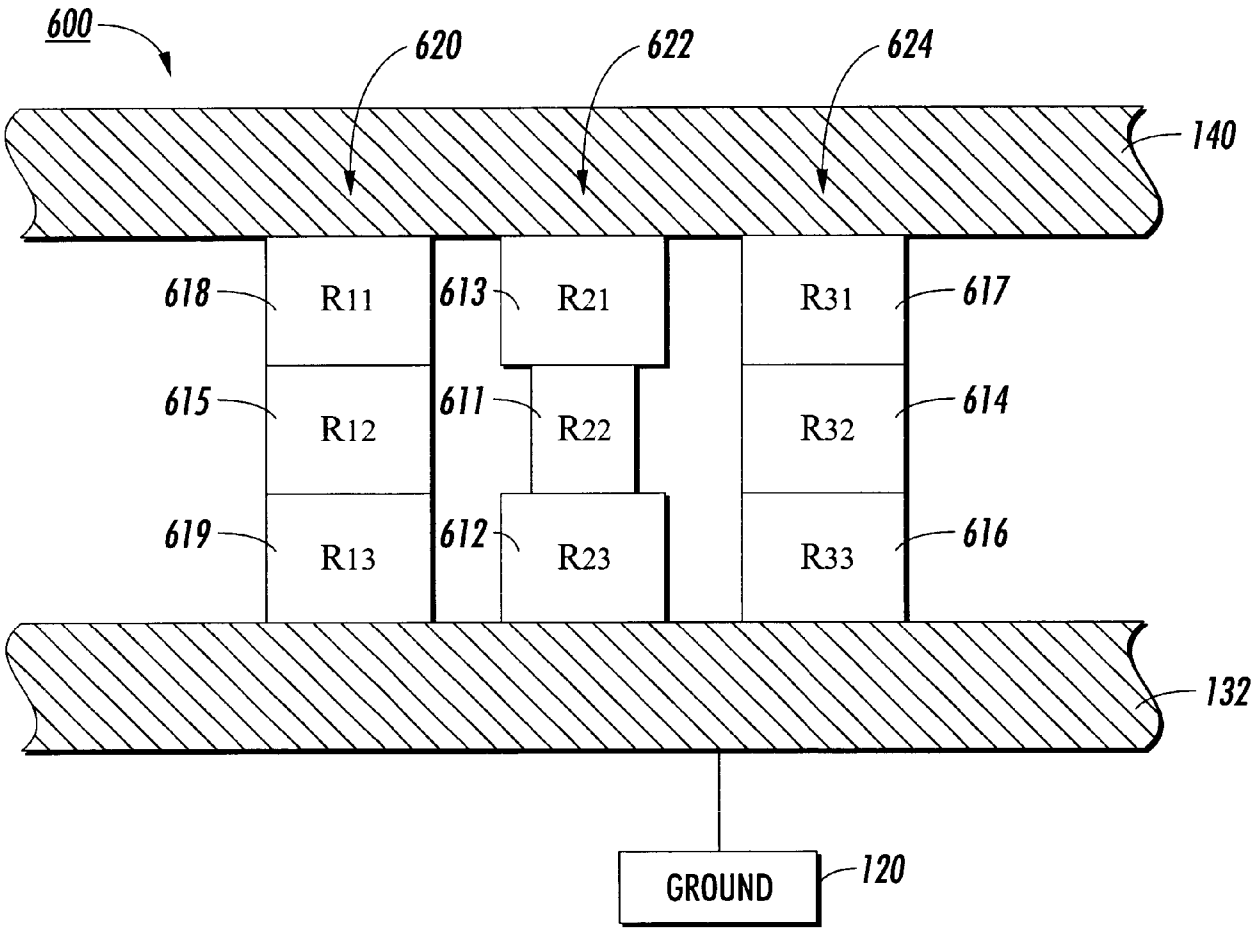
FIG. 6 a block diagram of a first exemplary embodiment of a segmented heater structure having a two-dimensional array of serially-connected heater segments according to this invention such that the resulting increase in power density proceeds substantially radially as the pulse width and/or voltage increases.

It should be appreciated that radial growth of the bubble nucleation region may be more closely approximated by a two-dimensional array of heater segments rather than the one-dimensional array as shown in FIGS. 1–5. While unidirectional growth of the bubble nucleation region is preferred for some devices, i.e., for side-shooting devices, radial growth is preferred for other devices, i.e., roof shooters devices, where the droplet is ejected in a direction which is perpendicular to the plane of the heater. FIG. 6 is a block diagram of a first exemplary embodiment of a segmented heater 600 having a two-dimensional array of serially-connected heater segments. As shown in FIG. 6, the segmented heater 600 has a plurality of heater devices 150, a common ground 120 and a common power supply 140. The segmented heater 600 has a plurality of heater devices 610, each multiple heater segments 611–619 arranged in a two-dimensional, i.e., 3 3, array. The heater segments 615 and 618–619 in a first column 620 have a total resistance of $r_{11}+r_{12}+r_{13}=R_1$, the heater segments 611–613 in a second column 622 have a total resistance of $r_{21}+r_{22}+r_{23}=R_2$ and the heater segments 614 and 616–617 of a third column 624 have a total resistance of $r_{31}+r_{32}+r_{33}=R_3$.

As shown in this example, each strip 620–624 is fabricated so that the total resistance in each strip $R_1$–$R_3$ is the same. Thus, the same amount of current flows through each column 620–624. Furthermore, in this exemplary embodiment, heater segment 611 is fabricated to have the lowest resistance. Next, heater segments 612 and 615 are fabricated to have the next lowest resistance. Finally, heater segments 616–619 are fabricated to have the highest resistance. Accordingly, as the pulse voltage and/or the pulse width increases, heater segment 611 has the highest power density and will reach the bubble nucleating temperature first. Once again, while current flows through all of the heater segments 611–619, only the first heater segment 611 has a power density that is sufficient, given the resistance $r_{22}$ of the first heater segment 611, to raise the temperature of the fluid adjacent to the heater segments 611–619 above the bubble-nucleation temperature of the fluid. As previously discussed, the size of the bubble, and thus the size of the resulting fluid droplet, is a function of the area of the heater device that has a temperature greater than the bubble-nucleation temperature. Thus, the size of the bubble, and thus the size of the resulting fluid droplet, is based only on the area of the first heater segment 611.

As the pulse voltage and/or the pulse width continues to increase, the temperature of the first heater segment 611 remains above the bubble-nucleating temperature. Furthermore, even though the temperature of the heater segment 611 increases, this further increase in the temperature of the first heater segment 611 has at most only a minimal effect on the size of the bubble, and thus the size of the resulting fluid droplet, due to the high thermal resistance of the bubble. However, the temperatures of all of the remaining heater segments 612–619 rise toward the bubble-nucleating temperature. However, because the power densities of heater segments 612–615 are greater than the power densities of heater segments 616–619, the temperature of the heater segments 612–615 increases more rapidly than the temperature of the heater segments 616–619. Thus, at some particular pulse voltage and/or pulse width, the temperature of the heater segments 612–615 reach the bubble-nucleating temperature. As a result, the size of the resulting bubble becomes dependent on the areas of the heater segments 611–615. Thus, the size of the resulting fluid droplet increases.

As the pulse voltage and/or pulse width continues to increase, the temperature of each of the heater segments 616–619 continues to increase, with the temperature of the heater segments 616–619 rising towards the bubble-nucleating temperature. As outlined previously, at some pulse voltage and/or pulse width, the temperature of the heater segments 616–619 reach the bubble-nucleating temperature last because the power densities on heater segments 616–619 are lower than the power densities of heater segments 611–615. As a result, the size of the resulting bubble, and thus the size of the resulting fluid droplet, increase in size because all of the heater segments 611–619 are now at, or above, bubble nucleating temperature.

It should be appreciated that the two-dimensional firing order described in this embodiment may be accomplished in different ways, based on variations in heater segment widths, heater segment lengths, and sheet resistances, or various combinations of these parameters, thereby having different relative power densities in the heater segments 611–619. Likewise, it should be appreciated that the resistances of the various heater segments 611–619 can be varied so that as the pulse voltage and/or pulse width increases, different sets of heater segments 612–619 begin firing droplets of fluid at different points than as described above. For example, the temperature of each of the heater segments 612–619 could rise above the bubble-nucleation temperature independently of each other, or in sets of two rather four of the heater segments.

Figure 7:
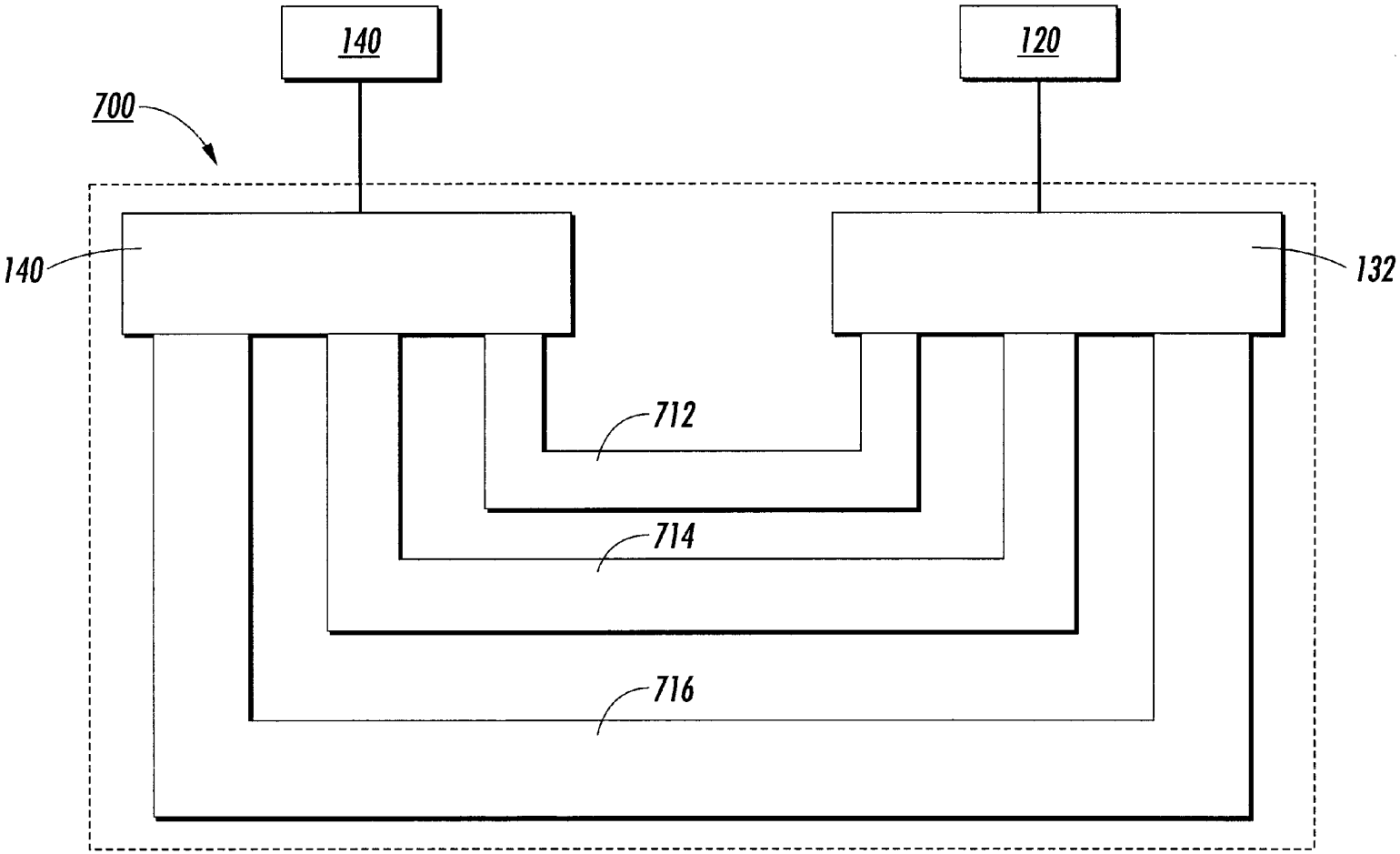
FIG. 7 is a block diagram of a first exemplary embodiment of a segmented heater structure having parallely-connected heater segments according to this invention such that the resulting increase in power density proceeds substantially radially as the pulse width and/or voltage increases.
Figure 8:
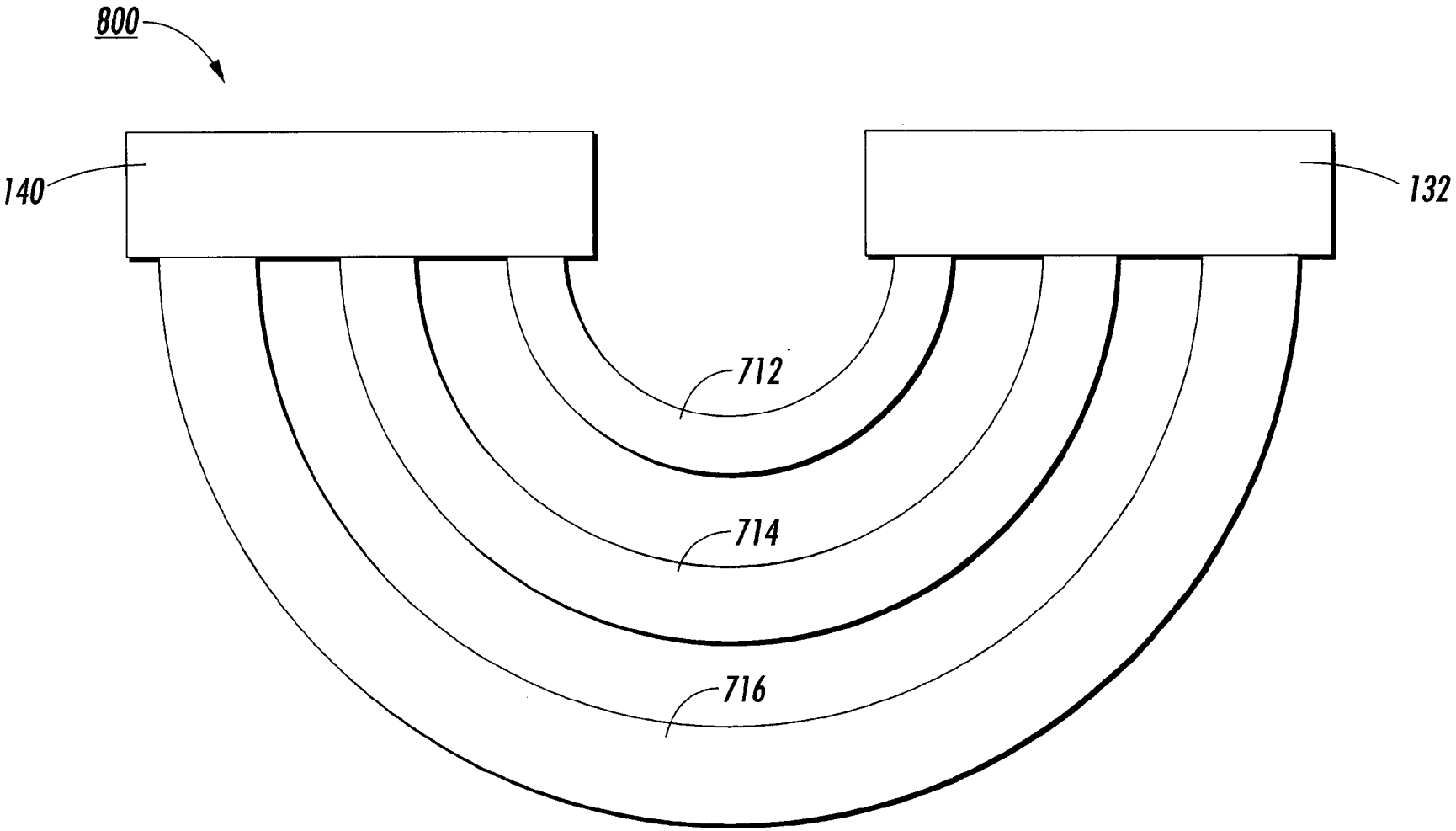
FIG. 8 a block diagram of a second exemplary embodiment of a segmented heater structure having parallely-connected heater segments according to this invention such that the resulting increase in power density proceeds substantially radially as the pulse width and/or voltage increases.

FIGS. 7 and 8 are block diagrams of first and second exemplary embodiments of segmented heaters 700 and 800 providing a substantially radial growth in the bubble nucleated region, accomplished through parallely-connected heater segments which have geometrical shapes that allow a substantially radial variation in power density. As shown in FIGS. 7 and 8, the U-shaped segmented heaters 700 and 800 each have a power supply 140 and a plurality of heater devices 150 that include a drive transistor 132. In contrast to the parallely-connected heater segments shown in FIGS. 2 and 3, connections of the heater segments 712–714 to the drive transistor 132 and to a terminal 142 of the power supply 140 are located on the same side of the heater device 150. Accordingly, the heater segments 712–714 are connected in parallel to the power supply 140 and to the drive transistor 132. The structure of the segmented heater 700 thus provides some of the same features of substantially radially increasing power density as the two-dimensional array of heater segments 611–619 shown in FIG. 6. In the segmented heater 700, the inside corners of heating segments 712–714 can be rounded in order to avoid hotspots in unwanted locations. Furthermore, the segmented heaters shown in FIG. 8 are functionally similar to those in FIG. 7, but are more rounded. The power densities in heater segments 712–714 for the parallely connected configurations illustrated in FIGS. 7 and 8 are shown in Equation 4, so that power density is inversely proportional to sheet resistance and inversely proportional to the square of the length of the segment. Assuming all heater segments 712–714 have the same sheet resistance, the innermost heater segment 712 has the shortest length, and therefore the highest power density. Thus, bubble nucleation will begin toward the center of the array of heater segments 712–714 and proceed substantially outward if all heater segments 712–714 have the same sheet resistance. The timing of the firing can further be influenced by the sheet resistivity if desired. The relative sizes of bubbles generated by different pulse widths and/or voltages can be influenced by the length and width of the heater segments 712–714.

While this invention has been described in conjunction with a specific embodiments thereof, it is evident that many alternatives, modifications and variations will be apparent to those skilled in the art. Accordingly, preferred embodiments of the invention as set forth herein are intended to be illustrative, not limiting. There are changes that may be made without departing from the spirit and scope of the present invention.

What is claimed is:

1. A segmented heater device usable to heat and vaporize fluid, comprising:

a power supply;

a plurality of driver transistors;

a plurality of heater devices, each heater device electrically connected in between a corresponding driver transistor and the power supply;

wherein:

the heater device have a segmented heater structure having a plurality of heater segments, each of the heater segments of each of the heater devices having a same length, but varying in width so to at the heater segments cause bubble nucleation to sequentially occur in one direction beginning with the heater segment closest to an area where the fluid is ejected; and the heater segments are electrically connected to the driver transistor and the power supply on side areas of the heater segments by leads that extend from the power supply and the drive transistor in opposite directions.

2. The segmented heater device of claim 1, wherein the leads that extend from the power supply and the leads that extend from the drive transistor extend in opposite directions in a parallel direction so that inner surfaces of the leads face each other.

3. The segmented heater device of claim 1, wherein the heater device comprises individual heater segments.

4. The segmented heater device of claim 3, wherein the individual heater segments are rectangular in shape.

5. The segmented heater device of claim 4, wherein the individual heater segments comprise doped polysilicon.

6. The segmented heater device of claim 1, wherein, after a first amount of electrical energy is supplied to the segmented heater device, at most one of the plurality of heater segments increase in temperature above a bubble-nucleation temperature of the fluid.

7. The segmented heater device of claim 6, wherein the heater device comprises a plurality of individual heater segments, each of the plurality of individual heater segments having a different power density.

8. The segmented heater device of claim 7, wherein each of the plurality of individual heater segments has a power density that is inversely proportional to a sheet resistance and inversely proportional to a square of the length of each of the plurality of individual heater segments.

9. The segmented heater device of claim 1, wherein at least a first subset of the plurality of individual heater segments increase in temperature above a bubble-nucleation temperature of the fluid before at least a second subset of the plurality of individual heater segments increase in temperature above a bubble-nucleation temperature of the fluid as the electrical energy applied to the segmented heater device is increased.

10. The segmented heater device of claim 1, wherein the heater device comprises a plurality of individual heater segments, each of the plurality of individual heater segments having a different resistance.

11. The segmented heater device in claim 1, wherein the leads are shared between pairs of adjacent heater devices.

12. A segmented heater device usable to heat and vaporize fluid, comprising:

a power source;

a plurality of driver transistors; and a plurality of hearer devices, each heater device electrically connected in between a corresponding driver transistor and the power supply;

wherein:

the plurality of heater devices have a segmented heater structure having a plurality of heater segments directly connected to each other, and which vary in width and length; and the heater segments are at least in part serially electrically connected between the driver transistor and the power supply so that inner heater segments are not in direct electrical contact with the corresponding driver transistor and the power supply, the heater segments causing bubble nucleation to sequentially occur in one direction beginning with the heater segment closest to an area where the fluid is ejected.

13. The segmented heater device of claim 12, wherein:

the plurality of serially connected heater segments are arranged in a column; and a power density of each of the plurality of the heater segments of a column is based on heater segments that are symmetrically arranged around a center heater segment of the column so that an area of the heater segments proportionally increases as the column expands outward from a center portion of the column.

14. The segmented heater device of claim 12, wherein, after a first amount of power is supplied to the segmented heater device, at most one of the plurality of heater devices increase in temperature above a bubble-nucleation temperature of the fluid.

15. The segmented heater device of claim 12, wherein the heater devices comprise a plurality of heater segments, each of the plurality of heater segments having a different power density.

16. The segmented heater device of claim 12, wherein each of the plurality of serially-connected heater segments has a power density that is inversely proportional to a sheet resistance and inversely proportional to a square of a width of each of the plurality of heater segments.

17. The segmented heater device of claim 12, wherein at least a first subset of the plurality of heater segments increase in temperature above a bubble-nucleation temperature of the fluid before at least a second subset of the plurality of heater segments increase in temperature above a bubble-nucleation temperature of the fluid as the electrical energy applied to the segmented heater device is increased.

18. The segmented heater device of claim 12, wherein the plurality of heater devices comprise a plurality of individual heater segments, each of the plurality of individual heater segments having a different resistance.

19. The segmented heater device of claim 12, wherein the heater segments comprise doped polysilicon.

* * * * *